US007445652B2

(12) United States Patent
Bax

(10) Patent No.: US 7,445,652 B2
(45) Date of Patent: Nov. 4, 2008

(54) EVAPORATOR SYSTEM

(75) Inventor: Johannes Cornelis Bax, Waddixveen (NL)

(73) Assignee: NEM B.V. (NL)

( * ) Notice: Subject to any disclaimer, the term of this patent is extended or adjusted under 35 U.S.C. 154(b) by 764 days.

(21) Appl. No.: 10/971,513

(22) Filed: Oct. 22, 2004

(65) Prior Publication Data

US 2005/0087151 A1 Apr. 28, 2005

(30) Foreign Application Priority Data

Oct. 23, 2003 (EP) ..... 03024267

(51) Int. Cl.
*B01D 45/00* (2006.01)

(52) U.S. Cl. ..... 55/345; 55/459.1; 122/488

(58) Field of Classification Search ..... 55/345, 55/392, 397, 410, 447, 457, 459.1, 482; 122/488, 122/489, 492; 95/267, 269, 271; 110/203; 96/155, 204, 209, 408

See application file for complete search history.

(56) References Cited

U.S. PATENT DOCUMENTS 3,332,401 A * 7/1967 Lustenader ..... 122/31.1
3,508,527 A * 4/1970 Durrer ..... 122/483
4,379,734 A * 4/1983 Franzen ..... 159/17.1
4,393,816 A * 7/1983 Bock ..... 122/412
4,624,111 A 11/1986 Lang
4,730,577 A * 3/1988 Houghton ..... 122/33
4,856,461 A * 8/1989 Hayes ..... 122/488
4,864,970 A * 9/1989 Bardoff ..... 122/32
5,025,630 A * 6/1991 Marjollet et al. ..... 60/646
5,976,207 A 11/1999 Vollmer
6,336,429 B1 * 1/2002 Wiener et al. ..... 122/488

FOREIGN PATENT DOCUMENTS

GB 523544 7/1940
GB 889608 2/1962

* cited by examiner

*Primary Examiner*—Duane Smith
*Assistant Examiner*—Sonji Turner
(74) *Attorney, Agent, or Firm*—Robert W. Becker; Robert W. Becker & Assoc

(57) ABSTRACT

An evaporator system for an industrial boiler is provided and includes a heat-transfer system for generating a water-steam mixture. At least one horizontal vessel is provided for the primary separation of water and steam. At least one vertical vessel is provided and contains a water level great enough to create the necessary pressure to force the separated water to flow back from the vertical vessel to the evaporator system. The horizontal vessel and the vertical vessel are connected to one another by a piping through which the separated wet steam is transported from the horizontal vessel to the vertical vessel. The horizontal vessel has a connection to a piping for receiving water. The vertical vessel has a connection to piping for extracting dried steam from the vertical vessel.

4 Claims, 1 Drawing Sheet

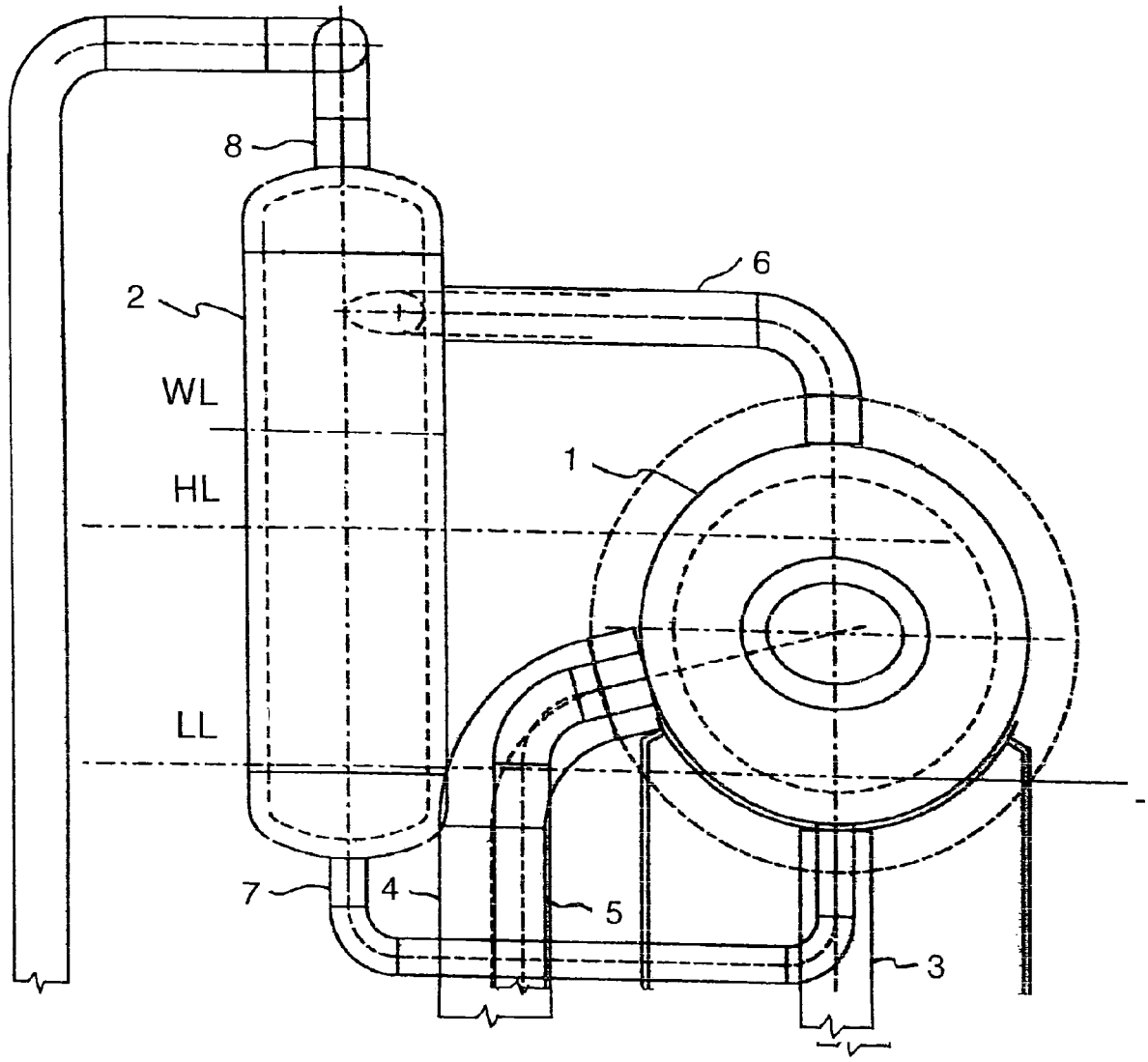
8
6
2
WL
1
HL
LL
7
4
5
3

EVAPORATOR SYSTEM

BACKGROUND OF THE INVENTION

The present invention relates to an evaporator system for an industrial boiler, and includes a heat transfer system for generating a water-steam mixture, means for separating water and steam from the water-steam mixture, and means for drying the separated wet steam.

In its most fundamental form such an evaporator system consists of a water-steam drum, a heat transfer section and interconnecting piping. Water from the drum is transported to the heat transfer section where it is partly evaporated. The thus generated water-steam mixture is transported back to the drum, where the steam is separated from the water and the separated steam is dried. Other connections on the evaporator system are for feed water supply and steam extraction.

Conventionally the water-steam drum is a vessel having a relatively large diameter because of the functions it has to fulfill. It is designed to contain the minimum amount of water required among others to guarantee the steam generation of the boiler when the feed water supply to the drum is momentarily interrupted. It is designed to contain the minimum steam volume required among others to have space for a water-steam separator and a steam dryer to realize a guaranteed steam purity at steam extraction and to have space for a water level that shifts to compensate for the fluctuating amount of water contained in the heat transfer section during start-up, shut-down and other load changes of the boiler.

The relatively large diameter in combination with relatively high steam pressures leads to a relatively large wall thickness, which limits the allowable temperature transients related to load changes of the boiler.

From EP-B-0 158 891 (U.S. Pat. No. 4,624,111) a process is known in which downstream of a high pressure steam turbine a water-steam pre-separator, a second water-steam separator and a reheater are connected in series. The saturated steam discharged from the high pressure steam turbine flows through the pre-separator first, then through the second separator, and finally through the reheater. The separated water is led from both separators to a water pre-heater.

It is an object of the present invention to design the separating and drying means of the known evaporator system in such a way that wall thicknesses are reduced and as a result thereof faster load changes of the evaporator system are allowed.

SUMMARY OF THE INVENTION

Starting from an evaporator system of the aforementioned general type, the evaporator system of the present application is characterized by at least one horizontal vessel containing a required minimum amount of water, a relatively small steam volume, and internals for the primary separation of water and steam; and by at least one vertical vessel containing internals for drying the wet steam to pre-determined values and containing a water level in a certain range high enough to create the necessary pressure to force the separated water to flow back from the vertical vessel to the evaporator system; the horizontal vessel and the vertical vessel are connected to one another by a piping through which the separated wet steam is transported from the horizontal vessel to the vertical vessel; the horizontal vessel has a connection to a piping for transporting water to the horizontal vessel; and the vertical vessel has a connection to piping for extracting dried steam from the vertical vessel.

The invention is based on the split up and assignment of the functions of separating water and steam and drying the separated steam to various vessels having relatively small diameters, in combination with a heat transfer section optimized with regard to minimal water-steam volume. One or more horizontal vessels connected in parallel in a horizontal plane contain the required minimum amount of water and a relatively small steam volume. The water-steam mixture generated in the heat transfer section is first transported to these horizontal vessels, where the primary separation of water and steam is realized. Subsequently the separated wet steam is transported to one or more vertical vessels connected in parallel, where the final steam drying takes place. The water level in the vertical vessels is high enough to create the necessary pressure to force the separated water to flow back to the evaporator system or to flow to another suitable system. The dried steam is extracted to a superheater for instance.

Because of the small wall thickness of the vessels, the system is suited for high temperature transients and thus fast load changes of the boiler.

Apart from the relatively small wall thickness of the vessels, other advantages should be mentioned. The number of horizontal and vertical vessels can be chosen independently, so that the vessels can be designed optimal for their function. As a possible design the water extracted from the vertical vessels may be transported back to the evaporator system, while the required pressure may be realized by a difference in water level between vertical and horizontal vessels. In that case, because of their diameters, the vertical vessels only slightly contribute to the water content of the system, even if their number is large compared to the number of horizontal vessels. As a result the water level in the vertical vessels adapts quite fast to changes in boiler load, while having only a small side effect on the water level in the horizontal vessels.

BRIEF DESCRIPTION OF THE DRAWING

An embodiment of the invention is shown in the sole FIGURE of the drawing and will be explained in detail in the following. The drawing shows schematically a water-steam separator.

DESCRIPTION OF SPECIFIC EMBODIMENTS

An evaporator system of an industrial boiler with a not shown heat transfer system for generating a water-steam mixture is provided with a water-steam separator. The water-steam separator comprises a horizontal vessel 1 that contains the required minimum water volume and internals that realize a primary separation of water and steam. These internals are not shown because they are conventional. The internals force the water-steam mixture entering the vessel 1 to slow down and to take one or more turns, whereby the mixture is separated into water and wet steam. Instead of one vessel 1 several vessels of similar design to vessel 1 may be arranged in one horizontal plane and connected in parallel. A water level is introduced in the vessel 1 somewhere between a low level LL and a high level HL dependent on the operation mode of the boiler such as start-up or normal operation.

Piping 3, 4, 5 are connected to the vessel 1. The piping 3 transports water from vessel 1 to the heat transfer section, the piping 4 transports the water-steam mixture from the heat transfer section back to the vessel 1, and through piping 5 feed water is supplied to the vessel 1.

The water-steam separator further comprises a vertical vessel 2 (arranged separately from the horizontal vessel 1), in which the final steam drying takes place. This is carried out by forcing the wet steam to follow a trajectory spiraling downward by introducing it tangentially into vessel 2. Instead of, or in addition to, such cyclone means a demister may be installed within vessel 2. The upper part of vessel 1 is connected to vessel 2 by a piping 6, through which the wet steam separated in vessel 1 is transported to vessel 2. The lower parts of vessel 1 and vessel 2 are connected to each other by a piping 7, through which the water separated in vessel 2 is transported back to vessel 1. A piping 8 is connected to the upper part of vessel 2 through which piping the dried steam is extracted from vessel 2. Instead of one vessel 2 several vessels of similar design to vessel 2 may be arranged in one horizontal plane and connected in parallel.

A water level WL may be introduced in vessel 2 above the current water level in vessel 1 (of which the latter level is controlled somewhere between the levels LL and HL, dependent on the operating mode of the boiler), thus creating enough pressure to force the separated water to flow back to the evaporator system directly from vessel 2 to vessel 1 through the piping 7. When the pressure drop in piping 6 transporting the wet steam changes, for example as a result of changes in boiler load, the water level WL in vessel 2 will adapt fast without having much side effect on the current water level in vessel 1.

The specification incorporates by reference the disclosure of German priority document EP 03024267.1 filed Oct. 23, 2003.

The present invention is, of course, in no way restricted to the specific disclosure of the specification and drawings, but also encompasses any modifications within the scope of the appended claims.

We claim:

1. An evaporator system for an industrial boiler, including a heat transfer system for generating a water-steam mixture, comprising:

at least one horizontal vessel for receiving water-steam mixture, wherein said horizontal vessel contains an amount of water, a steam volume and internal fixtures for a primary separation of water and steam;

at least one vertical vessel containing internal fixtures for drying wet steam to pre-determined values and containing a water level high enough to create a necessary pressure to force the separated water to flow back from said vertical vessel to the heat transfer system of said evaporator system;

means for connecting said horizontal vessel and said vertical vessel to one another for a transport of separated wet steam from said horizontal vessel to said vertical vessel and for a transport of separated water from said vertical vessel to said horizontal vessel;

means for transporting the water-steam mixture of said heat transfer system to said horizontal vessel; and means for extracting dried steam from said vertical vessel.

2. An evaporator system according to claim 1, wherein several horizontal vessels are connected in parallel and/or several vertical vessels are connected in parallel.

3. An evaporator system according to claim 1, wherein a water level in said vertical vessel is greater than a water level in said horizontal vessel.

4. An evaporator system according to claim 1, wherein at least one of said at least one horizontal vessel is connected to a means for transporting water from said horizontal vessel to said heat transfer system of said evaporator system.

* * * * *